United States Patent [19]

Kamins et al.

[11] 3,987,958

[45] Oct. 26, 1976

[54] HOOK AND HANDLE COMBINATION

[75] Inventors: Seymour Kamins, Oceanside; Frederick M. Shapiro, Levittown, both of N.Y.

[73] Assignee: CTP Industries, Inc., Brooklyn, N.Y.

[22] Filed: Aug. 15, 1975

[21] Appl. No.: 605,119

[52] U.S. Cl. ..... 229/54 R; 229/62

[51] Int. Cl.[2] ..... B65D 33/06; B65D 33/14; B65D 33/24

[58] Field of Search ..... 229/54 R, 62; 206/806; 150/12

[56] References Cited

UNITED STATES PATENTS

| | | | |
|---|---|---|---|
| 3,339,823 | 9/1967 | Bessermann-Nielsen | 229/54 R |
| 3,452,922 | 7/1969 | Hart | 229/54 R |
| 3,486,683 | 12/1969 | Kamins et al. | 229/54 R |

FOREIGN PATENTS OR APPLICATIONS

| | | | |
|---|---|---|---|
| 800,440 | 12/1968 | Canada | 229/54 R |

*Primary Examiner*—Stephen P. Garbe

*Attorney, Agent, or Firm*—Pollock, Vande Sande & Priddy

[57] ABSTRACT

A transparent plastic bag with an opening at one end to the opposite sides of which are fixed plastic handle members which when snapped together will provide a convenient means of carrying said bag or suspending it for the purposes of display, such suspension being provided by an inclined J-shaped slot in only one of the handle members.

1 Claim, 5 Drawing Figures

FIG. 1
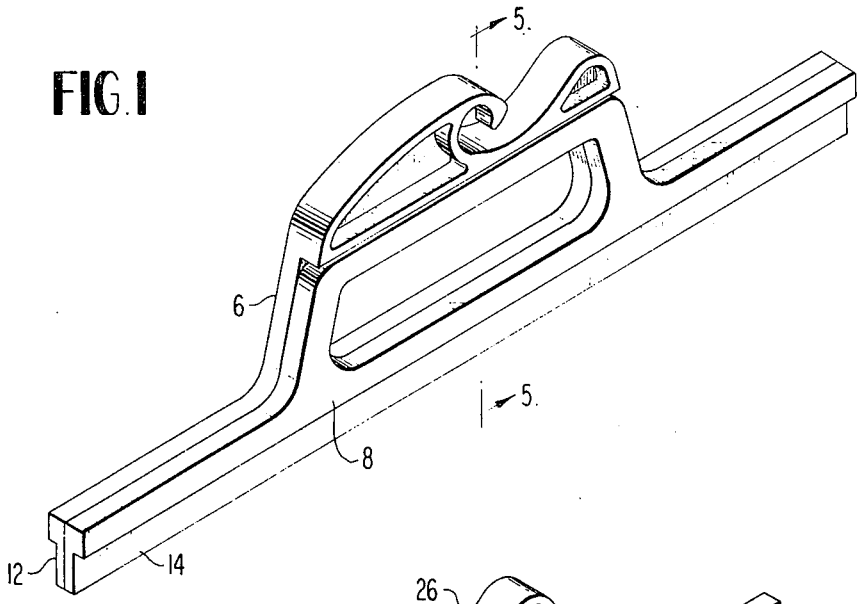
FIG. 5
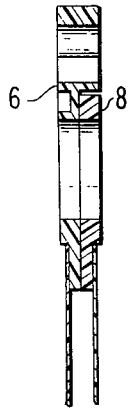
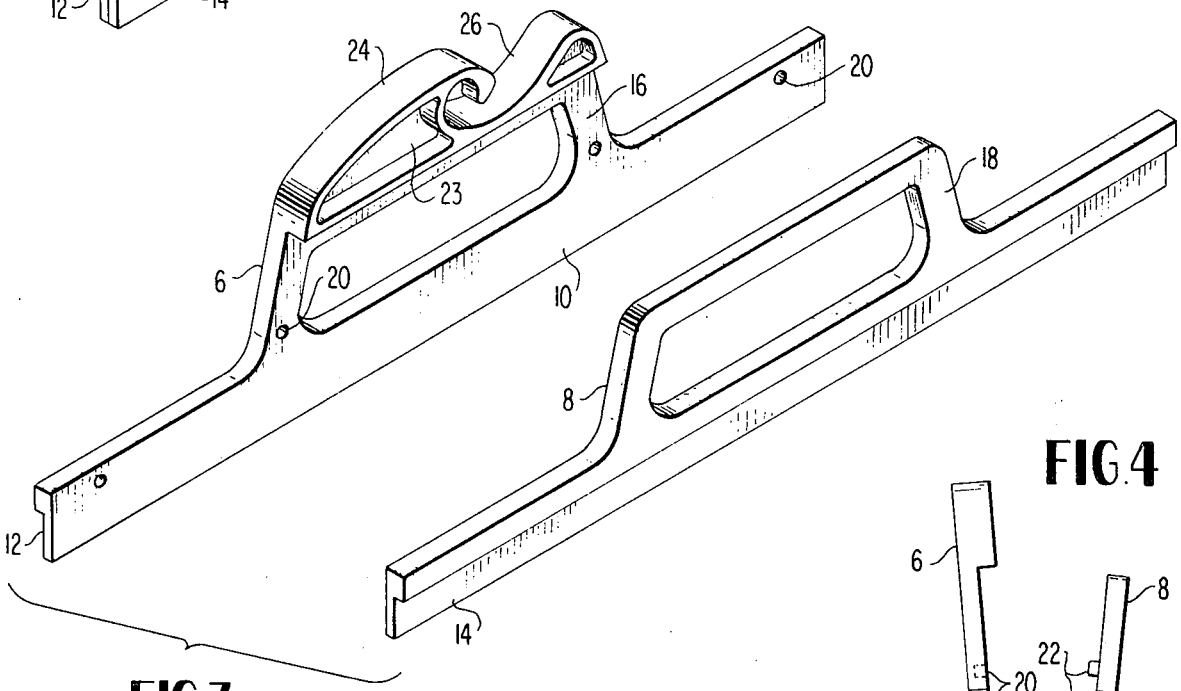
FIG. 3
FIG. 4
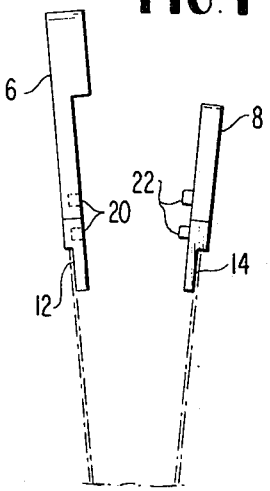
FIG. 2
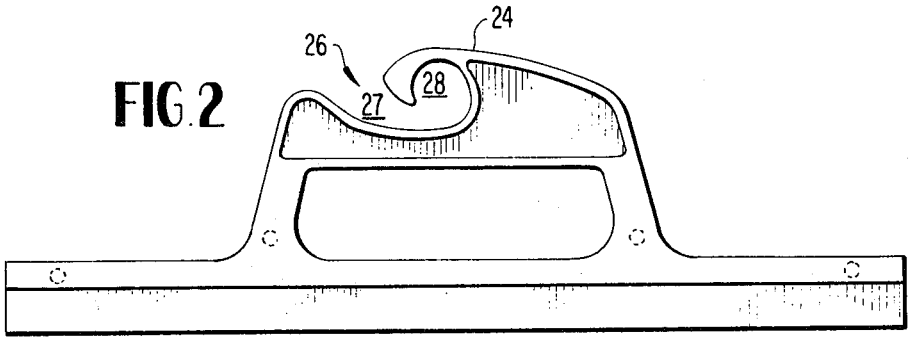

HOOK AND HANDLE COMBINATION

BACKGROUND OF THE INVENTION

Various types of bags made of thermoplastic material are known in the art. Many such prior art bags include a combination carrying and closure means for the bag which makes it possible to provide a tight closure thereof so that its contents cannot readily be lost, nor can dirt or moisture readily enter the bag.

It is also well-known in the art to provide bags whose main body portion is formed of a thin film of thermoplastic material, such as the more common vinyl or polyethylene plastics. The prior art further teaches the use of a combination carrying and closure means for such a thin film plastic bag which is heat sealed or cemented or otherwise fastened to the thin film. It is also common to fabricate the carrying and closure means from thermoplastic material having a substantially heavier gauge than that of the thin film used for the main portion of the bag since this provides a desirable rigidity to the mouth of the bag, thereby making it more convenient to open the bag and to maintain it open for obtaining access to the bag's interior.

In addition to the following, it is also known in the art to provide a combination carrying and closure means, which consists essentially of two generally congruent strips of a semi-rigid material, such as a heavy gauge plastic, which are welded or heat sealed to the mouth of the bag. To open the bag, it is then only necessary to grasp the two handle portions with one's right and left hands, respectively, and separate the two handle portions. Quite often, a securing or locking means is employed, which tends to hold the two oppositely disposed handle portions together, thereby effectively maintaining a tight closure of the mouth of the bag. In its most practical form, such a fastening means may comprise frictionally engaging studs and recesses as shown, for example, in the U.S. Pat. No. 3,140,038 to Lagarre.

Carrier bags of the type disclosed in the above-mentioned Lagarre patent have achieved great commercial success throughout the world. However, there has frequently been a need to provide an alternative type of carrying means; namely, a hook which readily adapts the carrier bag to being displayed, prior to sale, from a display rod or the like. It has been found that the ability to display packaged goods in carrier bags while hung from a display rod or the like contributes greatly to the saleability of the goods. Attempts have been made to provide carrier bags for such display on a rod, by providing a recess or indentation along the inner edge of the outwardly extending bow portion, such recess providing a detent into which a rod can fit. However, it has been found that this is not an entirely satisfactory solution to the problem because of the tendency of the handle portion to slide laterally off the rod, thereby resulting in an unbalanced support for the bag, which tends to tilt the bags in various positions, rather than allowing them to hang vertically.

Other of these prior art bags, employing a combination hook and handle for display and carrying purposes, feature a hook handle comprised of two plastic handle members each of which possesses a hook-like top portion as well as a hand-receiving loop so that, when mated together, the two members form a single hooking device intended for display purposes as well as a handle for carrying. However, such a device is not the most aesthetically desirable. Furthermore, bags employing such a device must be removed from the rack or stand from which they hang before the contents of the bag can be removed for the purposes of either further inspection or determination of texture of the goods.

SUMMARY OF THE INVENTION

The present invention seeks to provide an improved handle and closure device for a carrier bag wherein the handle and closure device also serves the function of a retail display suspension means of the hook type.

Accordingly, it is an object of the present invention to provide a display tote bag with a combination hook and handle closure means such that only one of its two combined handle and closure members includes as one of its components a J-slot hook device employed in the commercial display of the bag and its contents.

It is another object of the present invention to provide a means by which the construction of the bag handle will allow for the convenient opening of the bag and inspection of its contents without necessitating the removal of the bag from the display apparatus itself. It is another object of the present invention to provide an article of the character described wherein the fastened closure hanging members are balanced such that when hanging from a display apparatus the bag will hang directly perpendicular from the pole or rack from which it is suspended, thus, providing a visually attractive and commercially desirable display arrangement.

BRIEF DESCRIPTION OF THE DRAWINGS

In describing this invention, reference will be made to the accompanying drawing, in which:

FIG. 1 is a perspective view of a thermoplastic closure and carrying means in accordance with the present invention whereby the carrying means comprises both a handle and a hanging portion;

FIG. 2 is a side view of one of the two parts comprising the assembly of FIG. 1;

FIG. 3 is a perspective view of the handles in a spaced-apart relationship;

FIG. 4 is an elevational view illustrating the handle and bag assembly in its unclosed condition; and FIG. 5 is an elevational cross-section view taken along the section line 5—5 of FIG. 1.

DETAILED DESCRIPTION OF THE PREFERRED EMBODIMENTS

FIG. 1 discloses a perspective view of the assembled members 6 and 8 which together comprise the combined closure and carrying means for a carrier bag of this invention. As disclosed, the two members 6 and 8 are not identical in configuration but are instead formed so as to be interfitting and complementary relative to each other. This permits them to be fastened together and interlock to provide a hand-hold portion and also an inclined J-slot which adapts the combination for hanging from a display rod or the like.

As shown in FIG. 3, the member 6 comprises an elongate strip portion 10 having a channel 12 formed therein along its length, and a corresponding channel 14 is also formed similarly along the length of the opposed member 8. These channels 12 and 14 are provided so as to enable the opposing sidewalls of the bag to be heat sealed thereto in the manner illustrated in FIG. 4.

Both of the members 6 and 8 define an upwardly extending bow portion of generally inverted U-shape 16 and 18 respectively. The hollow formed by this inverted U-shaped design provides a finger-receiving access for carrying the bag when the two members 6 and 8 are joined as shown in FIG. 1. Incidentally, it will be understood that the members 6 and 8 can readily be maintained in an interlocked fashion by reason of protruding studs on one or both of the members which fit into corresponding recesses in the other member. Such recesses are shown (See FIG. 4) in the member 6 at 20, and the corresponding protuberances are shown at 22.

Only the member 6 is provided with an upwardly extending portion 23 which extends above the bight portion of the U-shaped, bow portion 16. This portion is formed with a generally convex curvature at 24 and defines therein a generally J-shaped slot at 26. Such slot 26 comprises a generally downwardly inclined shank portion 27 which extends inwardly toward the central portion of the closure and handle means and terminates at such central portion in a generally upwardly extending base portion 28 of generally circular configuration which terminates short of the outer surface of the convexly curved portion 24 as shown in FIG. 2. Thus, it will be readily appreciated that one can quite readily hang the member 6 and thus also the mating member 8 and the depending bag from a slot by inserting the rod into the J-slot 26 so that it finally is disposed in the generally circular upwardly extending shank portion of such J slot.

Referring to FIG. 5, this illustrates the manner in which a virtual recess is formed in the member 6 for receiving the associated member 8. Thus, the portion 23 which defines the J slot in the member 6 not only extends upwardly above the corresponding U-shaped bow portion of the member 8 but also extends laterally and asymmetrically to one side, as can be particularly seen in FIG. 5, so as to overhang the abutting member 8. As a result, when the two members 6 and 8 are matably fastened as in FIGS. 1 and 5, the portion 23 defining the J slot is symmetrically disposed relative to the justaposed U-shaped portions 16 and 18.

When the two handle members 6 and 8 are snapped together, they provide a convenient and comfortable means by which the bag and its contents can be carried. The provision of the J slot in the upper reach of the U-shaped bow portion of only the one member further provides a convenient means for hanging and displaying the bag and its contents. Thus, the means of the present invention comprising the inclined J slot above the inverted U-shaped bow portion of only one of the two mated members makes it possible readily to open the bag without requiring that it be first removed from the rod by which it is suspended.

What I claim is:

1. In a carrier bag having front and rear walls formed of a thin-film thermoplastic material, the improvement comprising:

a combined handle and closure means for said bag including first and second members each formed of a flexible material having a thickness and tensile strength substantially greater than that of the thin-film material forming the bag walls, each said member having an elongate generally planar strip portion for attachment to a respectively opposite wall of the bag at the mouth thereof, each of said members having an upwardly extending bow portion of generally inverted U-shape integrally formed with said strip portion to define a finger-receiving recess for carrying said bag which recess has substantially parallel straight top and bottom surfaces, only one of said members having an upwardly extending portion extending above its bight portion, said upwardly extending portion being of convex curvature and further defining a generally J-shaped slot having an open mouth at its top edge and a shank portion slanting downwardly and centrally from said open mouth toward a base portion of said slot, said shank portion then extending upwardly toward but terminating short of the top edge of said upwardly extending portion, the other of said members having its bight portion formed of a narrow strip of said material having generally parallel top and bottom edges, said upwardly extending portion of said one member having a thickness which is approximately twice the thickness of said other member, whereby the mating of said two members provides a combined handle and closure means having generally smooth external surfaces, and means for releasably engaging said two members.

* * * * *